United States Patent [19]

Tomisawa et al.

[11] Patent Number: 4,729,359

[45] Date of Patent: Mar. 8, 1988

[54] LEARNING AND CONTROL APPARATUS FOR ELECTRONICALLY CONTROLLED INTERNAL COMBUSTION ENGINE

[75] Inventors: Naoki Tomisawa, Takasaki; Yasunari Koshiba, Tokyo, both of Japan

[73] Assignee: Japan Electronic Control Systems Co., Ltd., Japan

[21] Appl. No.: 879,197

[22] Filed: Jun. 25, 1986

[51] Int. Cl.[4] ..... F02B 3/00

[52] U.S. Cl. ..... 123/440; 123/489; 123/339

[58] Field of Search ..... 123/492, 440, 489, 480, 123/339

[56] References Cited

U.S. PATENT DOCUMENTS

| | | | |
|---|---|---|---|
| 3,483,851 | 12/1969 | Reichardt | 123/440 |
| 3,750,632 | 8/1973 | Zechnall | 123/440 |
| 4,284,050 | 8/1981 | Suchowerskyj et al. | 123/440 |
| 4,501,243 | 2/1985 | Niimi | 123/440 |
| 4,572,129 | 2/1986 | Otobe | 123/440 |
| 4,615,319 | 10/1986 | Tomisawa | 123/440 |
| 4,617,901 | 10/1986 | Otobe | 123/440 |

FOREIGN PATENT DOCUMENTS

| | | | |
|---|---|---|---|
| 59-203828 | 11/1984 | Japan | 123/440 |
| 59-203829 | 11/1984 | Japan | 123/440 |

*Primary Examiner*—Ronald B. Cox
*Attorney, Agent, or Firm*—Lowe, Price, LeBlanc, Becker & Shur

[57] ABSTRACT

A learning and control apparatus for an electronically controlled internal combustion engine having such an object of control as the air-fuel ratio in an air-fuel mixture or the idle rotation number of the engine wherein a pulse duty signal corresponding to a basic control value is set according to engine driving states. The basic control value is corrected by adding an appropriate correction value to the basic control value. Feedback control is carried out so that the actual controlled value is made to follow the aimed control value, and a learning correction quantity is computed by learning said feedback control so that the feedback control amount is set as small as possible. Since the new learning correction quantity is restricted by the preceding learning correction quantity, forcibly increasing or decreasing a control value which is computed based on said ordinary learning correction quantity when difference between the preceding and present learning correction quantities is larger than a predetermined value is executed, thereby controlling the object of control without time-lag is obtained effectively if the control value to be controlled is abruptly changed.

12 Claims, 9 Drawing Figures

36
Kℓ(old): Kℓ
BELOW
ABOVE
37
RETRIEVING OF Kmr°
38
Kℓ - Kℓ(old) ?
39
RETREVING OF Kmr+
<0
40
COMPUTING OF Kmr−
RETURN
33
Kℓ−Kℓ(old)+ Δᾱ/M
34
RENEWAL OF DATA Kℓ(old) OF SAME N AND Tp
35
Δα1 − Δα2

LEARNING AND CONTROL APPARATUS FOR ELECTRONICALLY CONTROLLED INTERNAL COMBUSTION ENGINE

BACKGROUND OF THE INVENTION (1) Field of the Invention

The present invention relates to an apparatus for controlling an object of control in an electronically controlled internal combustion engine while learning variations of the driving state of the engine with the lapse of time.

More particularly, in an electronically controlled internal combustion engine provided with fuel injection means which is opened and closed in an on-off manner by a driving pulse signal of electronic control means or with an idle speed control valve for determining the opening degree of a passage bypassing a throttle valve arranged in an intake passage by minute oscillation in the opening or closing direction according to said driving pulse signal, the present invention relates to an apparatus for learning and controlling the fuel injection quantity or the quantity of air passing through the bypassing passage at the time of idling.

(2) Description of the Prior Art

An electronically controlled fuel injection valve is opened by a driving pulse signal (injection pulse) given synchronously with the rotation of an engine and while the valve is opened, a fuel is injected under a predetermined pressure.

Accordingly, the injection quantity of the fuel depends on the period of opening of the valve, that is, the injection pulse width. Assuming that this pulse width is expressed as Ti and is a control signal corresponding to the injection quantity of the fuel, Ti is expressed by the following equations:

$$Ti = Tp \times COEF \times \alpha + Ts \text{ and } Tp = K \times Q/N$$

wherein Tp stands for the injection pulse width corresponding to the basic injection quantity of the fuel, which is called "basic fuel injection quantity" for convenience, K stands for a constant, Q stands for the flow quantity of air sucked in the engine, N stands for the rotation speed of the engine. COEF stands for various correction coefficients for correcting the quantity of the fuel, which is expressed by the following formula:

$$COEF = 1 + Ktw + Kas + Kai + Kmr + Ketc$$

in which Ktw stands for a coefficient for increasing the quantity of the fuel as the water temperature is lower, Kas stands for a correction coefficient for increasing the quantity of the fuel at and after the start of the engine, Kai stands for a correction coefficient for increasing the quantity of the engine after a throttle valve arranged in an intake passage of the engine is opened, Kmr stands for a coefficient for correcting the air fuel mixture, and Ketc stands for other correction coefficient for increasing the quantity of the fuel, $\alpha$ stands for an air-fuel ratio feedback correction coefficient for the feedback control ($\lambda$ control), described hereinafter, of the air-fuel ratio of the air-fuel mixture, and Ts stands for the quantity of the voltage correction for correcting the change of the flow quantity of the fuel injected by the fuel injection valve, which is caused by the change of the voltage of a battery.

In short, the desired injection quantity of the fuel is obtained by multiplying the basic fuel injection quantity Tp by various correction coefficients COEF, and when a difference is brought about between the aimed control value to be attained by the control and the actual controlled value, this difference is multiplied by $\alpha$ to effect the feedback control and the correction for the power source voltage is added to the feedback control.

This air-fuel ratio feedback correction control is disclosed in, for example, U.S. Pat. Nos. 4,284,050, 3,483,851 and 3,750,632.

However, in this air-fuel ratio feedback control, for example, when one constant driving region is greatly changed to a different constant driving region, if the base air-fuel ratio in this different stationary driving region is greatly deviated from $\lambda = 1$ ($\lambda$ stands for an actual air-fuel ratio), it takes too long a time to perform the feedback control (proportion and integration control . . . PI control) of the change of the base air-fuel ratio generated by this deviation to $\lambda = 1$. More specifically, even though the base air-fuel ratio has been obtained from the specific injection quantity Tp×COEF and the deviation of this air-fuel ratio from the theoretical air-fuel ratio has been corrected by the PI control based on $\alpha$, since the base air-fuel ratio is greatly changed, the base air-fuel ratio is controlled to a value greatly different from $\lambda = 1$ if Tp×COEF used up to this time is still used, and the feedback correction by similar PI control should be performed and it takes a long time to correct the base air-fuel ratio to $\lambda = 1$ by the feedback correction.

A control system in which the above-mentioned disadvantage is eliminated by learning the control quantity controlled by the system and increasing the respondency of the air-fuel ratio control in the same driving state has been proposed by us in Japanese Patent Application Laid-Open Specifications No. 203828/74 and No. 203829/74 and U.S. Patent Application Ser. No. 604,025, filed Apr. 26, 1984, now U.S. Pat. No. 4,615,319.

According to this control system, learning control of the air-fuel ratio feedback control is first carried out. More specifically, in the air-fuel ratio feedback control region, if the base air-fuel ratio is deviated from the aimed air-fuel ratio $\lambda t$, since the feedback correction coefficient $\alpha$ is increased for compensating this gap during the process of transfer, the driving state at this time and $\alpha$ are detected, and a learning correction coefficient K1 based on this $\alpha$ is determined and stored. When the same driving state is brought about, the base air-fuel ratio is corrected to the aimed air-fuel ratio $\lambda t$ with a good respondency by the stored learning correction coefficient K1. Storing of the learning correction coefficient. K1 is performed for all of engine-driving state areas of a predetermined range formed by lattice division of a map of RAM according to the rotation speed of the engine and the engine-driving conditions such as the load.

More specifically, the map of the learning correction coefficient K1 corresponding to the rotation speed of the engine and the driving conditions of the engine such as the load is formed on RAM, and when the injection quantity Ti is calculated, the basic injection quantity Tp is corrected by K1 as shown by the following equation:

$$Ti = Tp \times COEF \times K1 \times \alpha + Ts \quad (1)$$

Learning of K1 is advanced according to the following procedures.

(i) The engine-driving state in the constant state and the median $\alpha c$ of control of $\alpha$ (the mean value of a plurality of values K1 at the time of reversion of increase and decrease of the output signal of an $O_2$ sensor) are detected.

(ii) The value K1 (old) heretofore learned, corresponding to the engine-driving state, is retrieved.

(iii) The value of K1(old)$+\Delta\alpha/M$ is determined from $\alpha c$ and K1 (old), and the storage is renewed with the obtained value (learned value) being as new K1(new).

Incidentally, $\Delta\alpha$ stands for the deviation from the standard value $\alpha 1$ and expressed by $\Delta\alpha=\alpha-\alpha 1$. The standard value $\alpha 1$ is ordinarily set at 1.0 as the value corresponding to $\lambda=1$. M is a constant larger than 1.

However, in this conventional learning and control apparatus for an internal combustion engine, with increase of the frequency n of learning, the learning correction coefficient K1 is sequentially renewed to K1$+\Delta\alpha/M$ based on the preceding learning correction coefficient, and therefore, learning is advanced while the new learning correction coefficient is restricted by the preceding learning correction coefficient. Accordingly, if the injection quantity under the same driving conditions is abruptly changed on standing or by exchange of parts, learning cannot catch up with this change and the frequency of learning for obtaining a proper learning correction coefficient after the change is increased and a considerably long time is necessary for effecting learning over the entire region, and during this period, the exhaust characteristics are degraded.

Also in the apparatus disclosed in Japanese Patent Application Laid-Open Specification No. 211738/84, there arises the problem mentioned above in connection with learning and control of the fuel injection pulse width. According to this known technique, an idle control valve is disposed in an auxiliary air passage bypassing a throttle valve, and the opening degree of the idle control valve is adjusted according to the duty ratio of a pulse signal. The preset aimed rotation speed is compared with the actual rotation speed and feedback correction is effected, and a learning correction quantity stored in RAM in correspondence to the rotation speed is retrieved from the actual rotation speed. The weighted mean of the feedback correction quantity and the learning correction quantity is calculated, and the data in RAM are renewed by using this mean value as a new learning correction coefficient, and the above-mentioned feedback correction quantity and learning correction quantity are added to the preset basic control value of the pulse signal to operate the control value of the pulse signal for controlling the idle control valve. As in case of learning and control of the fuel injection pulse width, learning cannot catch up with an abrupt change of the control quantity in case of learning and control of the learning correction quantity.

SUMMARY OF THE INVENTION

The present invention has been completed under the above-mentioned background, and it is therefore a primary object of the present invention to provide a learning and control apparatus for an internal combustion engine, in which even if the objective value to be controlled is greatly changed by a trouble or the like, the internal combustion engine can be controlled with a good respondency to this change.

In the present invention, the main object of control is an electronically controlled fuel injection valve, and in this case, the control valve is the injection pulse width at the time of injection of a fuel.

In the present invention, also an idle speed control valve of the internal combustion engine is the object of control, and in this case, the control value is the pulse width of the opening degree of the valve.

Moreover, the present invention can be applied to learning and control of the ignition timing in the internal combustion engine.

In the present invention, if the object of control is the fuel injection valve, when the fuel injection quantity of the fuel injection valve is abruptly changed by a trouble and the learning correction quantity is hence greatly changed, the control value is corrected by the difference of the learning correction quantity brought about by this change, whereby the engine is controlled with a good respondency and degradation of the exhaust characteristics is prevented.

In the present invention, if the fuel injection quantity is selected as the object of control, in the region where the fuel injection quantity is small, the feedback control of the air-fuel ratio and the accompanying learning control are stopped to keep the fuel injection quantity constant, whereby divergency of the control is prevented and stable driving characteristics are obtained.

The above-mentioned primary object and functions of the learning and control apparatus for an electronically controlled internal combustion engine according to the present invention can be attained by a system structure shown in a form of block diagram in FIG. 1 and described below. More specifically, the learning and control apparatus according to the present invention comprises engine driving state-detecting for detecting various driving states of the internal combustion engine, basic control value setting means for setting a basic control value corresponding to an aimed control value of an object of control in the engine according to a detection signal of the detecting means, reloadable memory means for storing a learning correction quantity for correcting the basic control value for every driving state region of the engine, learning correction quantity retrieving means for retrieving the learning correction quantity of the corresponding region from said memory means based on the actual driving state of the engine, feedback correction quantity setting means for comparing the actual control value with the aimed control value and setting a feedback correction quantity for correcting said basic control value so that the actual control value is brought close to the aimed control value, learning correction quantity renewal means for setting a new learning correction quantity from the feedback correction quantity and the retrieved learning correction quantity and renewing the learning correction quantity stored in the memory means in the corresponding driving region by said new learning correction quantity, control value computing means for computing a control value from said basic control value, the retrieved learning correction quantity and the set feedback correction quantity, learning correction quantity difference computing means for computing the difference between the retrieved precedent learning correction quantity and the new learning correction quantity, judging means for judging whether or not the computed difference is larger than the predetermined value, correcting means for increasing or decreasing said control value by a predetermined quantity according to said difference when it is judged that said difference is larger than the predetermined value, and control means for controlling the engine based on the control value corrected by the correcting means when said difference is larger than the predetermined value or based on the control value of the control value computing means when said difference is smaller than the predetermined value.

The above-mentioned object and structure of the present invention will become more apparent from the following description concerning embodiments.

BRIEF DESCRIPTION OF THE DRAWING

FIGS. 6, 6A and 6B are flow charts illustrating a learning sub-routine in FIG. 5.

DETAILED DESCRIPTION OF THE PREFERRED EMBODIMENTS

Figure 1:
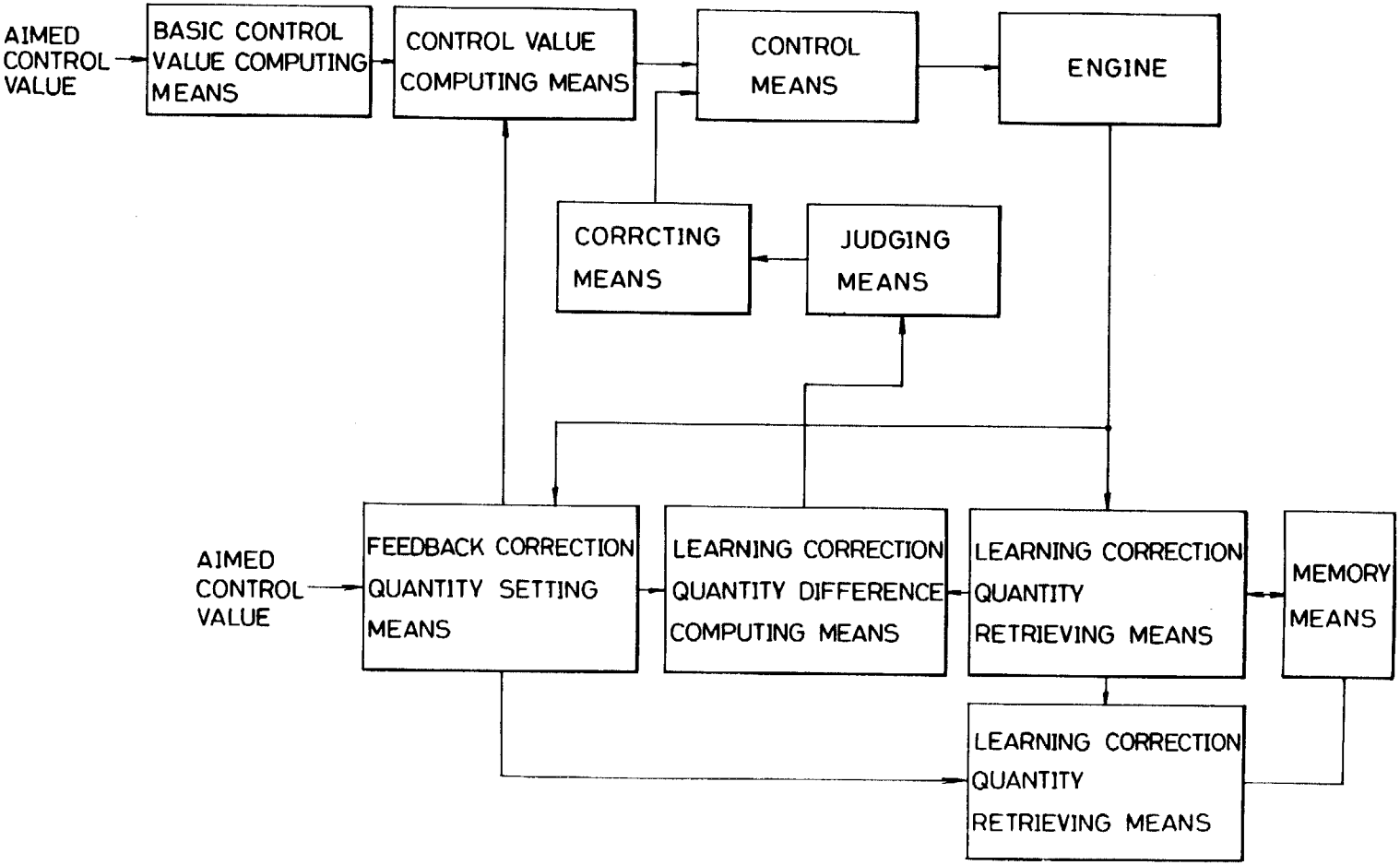
FIG. 1 is a schematic view illustrating an embodiment of the air-fuel ratio learning and control apparatus.
Figure 2:
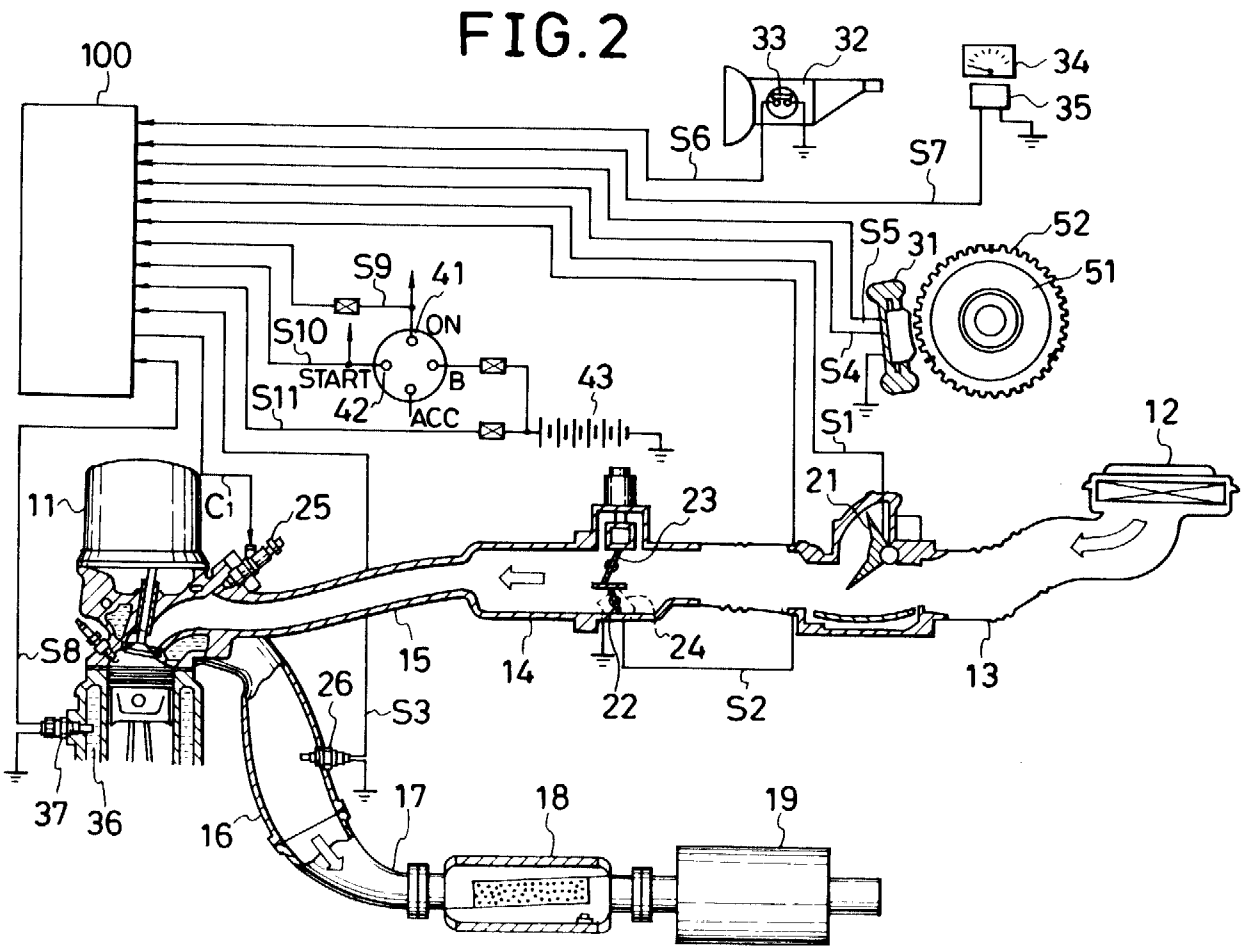
FIG. 2 is a block diagram illustrating the hard ware structure of a control unit used in one embodiment of the present invention.

Referring to FIG. 2, air is sucked in an engine 11 through an air cleaner 12, an intake duct 13, a throttle chamber 14 and an intake manifold 15 and an exhaust gas is discharged through an exhaust manifold 16, an exhaust duct 17, a ternary catalyst 18 and a muffler 19.

An air flow meter 21 is arranged in the intake duct 13 to put out a signal S1 of a flow quantity Q of intake air in the engine. The air flow meter 21 may be a hot wire type air flow meter. In the throttle chamber 14, a primary side throttle valve 22 interconnected with an accelerator pedal (not shown) and a secondary side throttle valve 23 are arranged to control the intake air flow quantity Q. A throttle sensor 24 of the variable resistor type is attached to a throttle shaft of the primary side throttle valve 22 to put out an electric current signal S2 corresponding to a change of the electric resistance corresponding to the turning angle, that is, the opening degree, of the throttle valve 22. An idle switch which is turned on when the throttle valve 22 is fully closed is mounted on the throttle sensor 24. A fuel injection valve 25 mounted on the intake manifold 15 or an intake port of the engine 11 is an electromagnetic fuel injection valve which is opened on actuation through a solenoid and is closed on deenergization. Namely, the valve 25 is actuated and opened through the solenoid by a driving pulse signal C1 to inject and supply into the engine a fuel fed under pressure from a fuel pump (not shown).

An $O_2$ sensor 26 acting as means for detecting the concentration of an exhaust component is arranged in the exhaust manifold 16. The $O_2$ sensor 26 is a known sensor which puts out a voltage signal S3 corresponding to the ratio of the oxygen concentration in the exhaust gas to air and the electromotive force of which is abruptly changed when an air-fuel mixture is burnt at the theoretical air-fuel ratio. Accordingly, the $O_2$ sensor is means for detecting the air-fuel ratio of the air-fuel mixture. The ternary catalyst 18 is a catalystic device for oxidizing or reducing CO, HC and NOx in the exhaust gas component at a high efficiency at an air-fuel ratio close to the theoretical air-fuel ratio of the air-fuel mixture to convert them to harmless substances.

These air flow meter 21, throttle sensor 24 and $O_2$ sensor 26 constitute main parts of means for detecting the driving state of the engine and detection signals S1 through S3 of said detecting means are put out into a control unit 100. The means for detecting the driving state of the engine, which puts out these detection signals to the control unit 100, comprises, in addition to the above-mentioned members, a crank angle sensor 31, a neutral switch 33 mounted on a transmission 32, a car speed sensor 35 mounted on a speed meter 34 of a car, and a water temperature sensor 37 for detecting the temperature of cooling water in a water jacket 36 for cooling the engine or cooling water in a thermostat housing of the cooling water circulation system. The crank angle sensor 31 is arranged to detect a rotation speed N of the engine and a crank angle (piston position), and a signal disc plate 52 is mounted on a crank pulley 51 and a crank angle sensor 31 puts out a reference signal S4 by, for example, every 180° in the crank angle in case of a 4-cylinder engine or by every 120° in the crank angle in case of a 6-cylinder engine and a position signal S5 by, for example, every 1° in the crank angle according to teeth formed on the periphery of the plate 52. When the transmission 32 is set at the neutral position, the neutral switch 33 detects this and puts out a signal S6. The car speed sensor 35 detects the car speed and puts out a car speed signal S7. The water temperature sensor 37 puts out a voltage signal S8 changing according to the change of the temperature of cooling water corresponding to the temperature of the engine.

The means for detecting the driving state of the engine further comprises an ignition switch 41 and a start switch 42. The ignition switch 41 is a switch for applying a voltage of a battery 43 to an ignition device and putting out an on-off signal S9 to the control unit 100. The start switch 42 is a switch which is turned on when a starter motor is driven to start the engine and which puts out an on-off signal S10. The terminal voltage of the battery 43 is put out to the control unit 100 by a signal S11.

The detection signals S1 through S11 emitted from the respective elements of the means for detecting the driving state of the engine are put into the control unit 100 where the operation processing is carried out to put out a signal C1 of an optimum injection pulse width to the fuel injection valve and obtain a fuel injection quantity giving an optimum air-fuel ratio.

Figure 3:
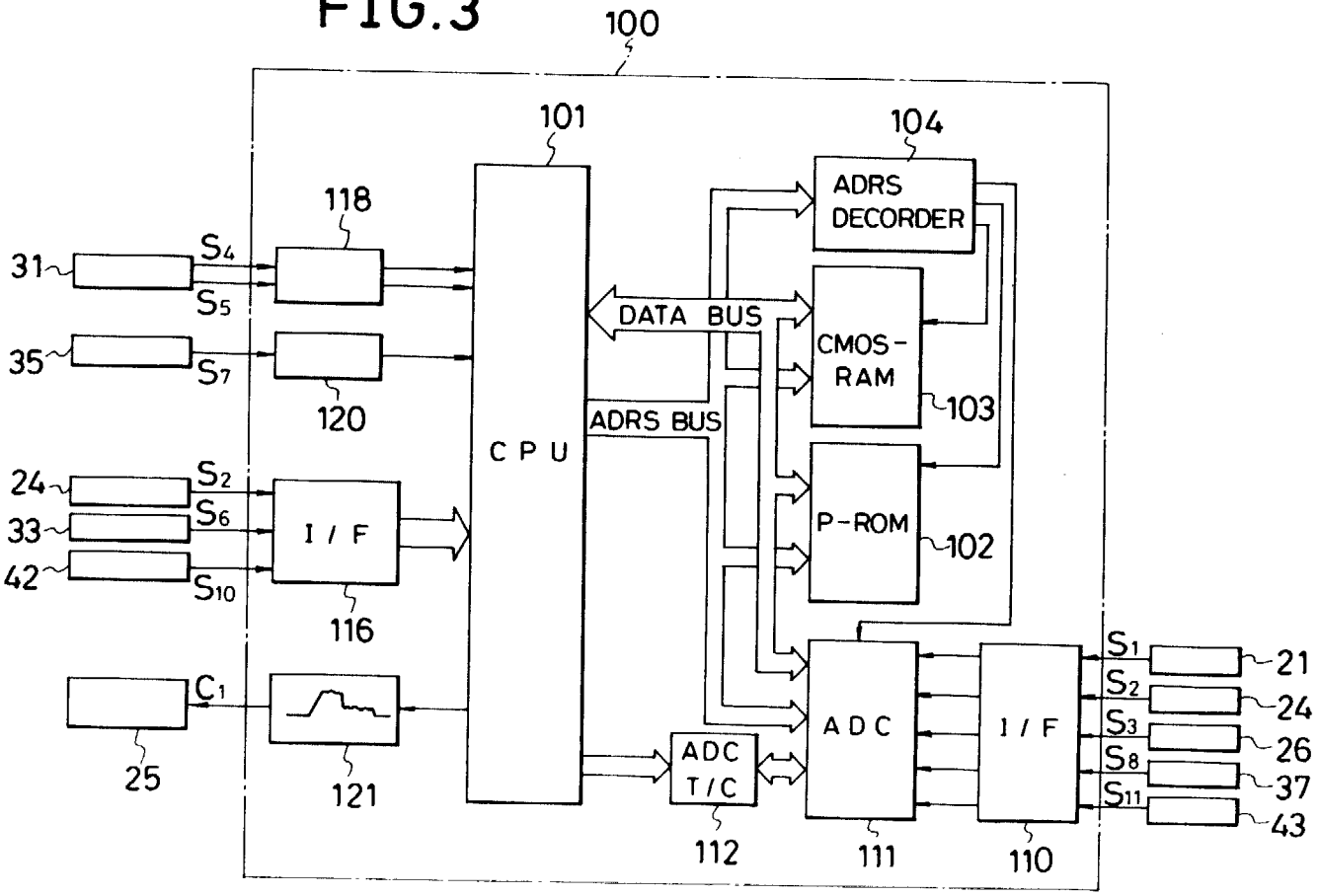
FIG. 3 is a block diagram of the air-fuel ratio learning and control apparatus according to the present invention.

The control unit 100 comprises CPU 101, P-ROM 102, CMOS-RAM 103 for the learning control of the air-fuel ratio and an address decoder 104, as shown in FIG. 3. A back-up power source circuit is used for RAM 103 to retain the content of the memory after the ignition switch 41 has been turned off.

As analogue input signals to be put in CPU 101 for the control of the fuel injection quantity, there can be mentioned the signal S1 of the intake air flow quantity Q from the air flow meter 21, the throttle opening degree signal S2 from the throttle sensor 24, the water temperature signal S8 from the water temperature sensor 37, the signal S3 of the oxygen concentration in the exhaust gas from the $O_2$ sensor 26 and the battery voltage signal S11. These signals are put in CPU 101 through an analogue input interface 110 and an A/D converter 111. The A/D converter 111 is controlled by CPU 101 through an A/D conversion timing controller 112.

As digital input signals, there can be mentioned the idle switch signal S2 which is turned on when the throttle valve 22 is fully closed, and on-off signals S10 and S6 supplied from the start switch 42 and the neutral switch 33. These signals are put in CPU 101 by way of a digital input interface 116.

Furthermore, for example, the reference signal S4 and position signal S5 from the crank angel sensor 31 are put in CPU 101 through a one-shot multichip circuit 118. Moreover, the car speed signal S7 from the car speed sensor 35 is put in CPU 101 through a wave shaping circuit 120.

The output signal from CPU 101 (driving pulse signal to the fuel injection valve 25) is supplied to the fuel injection valve 25 through a current wave control circuit 121.

Figure 5:
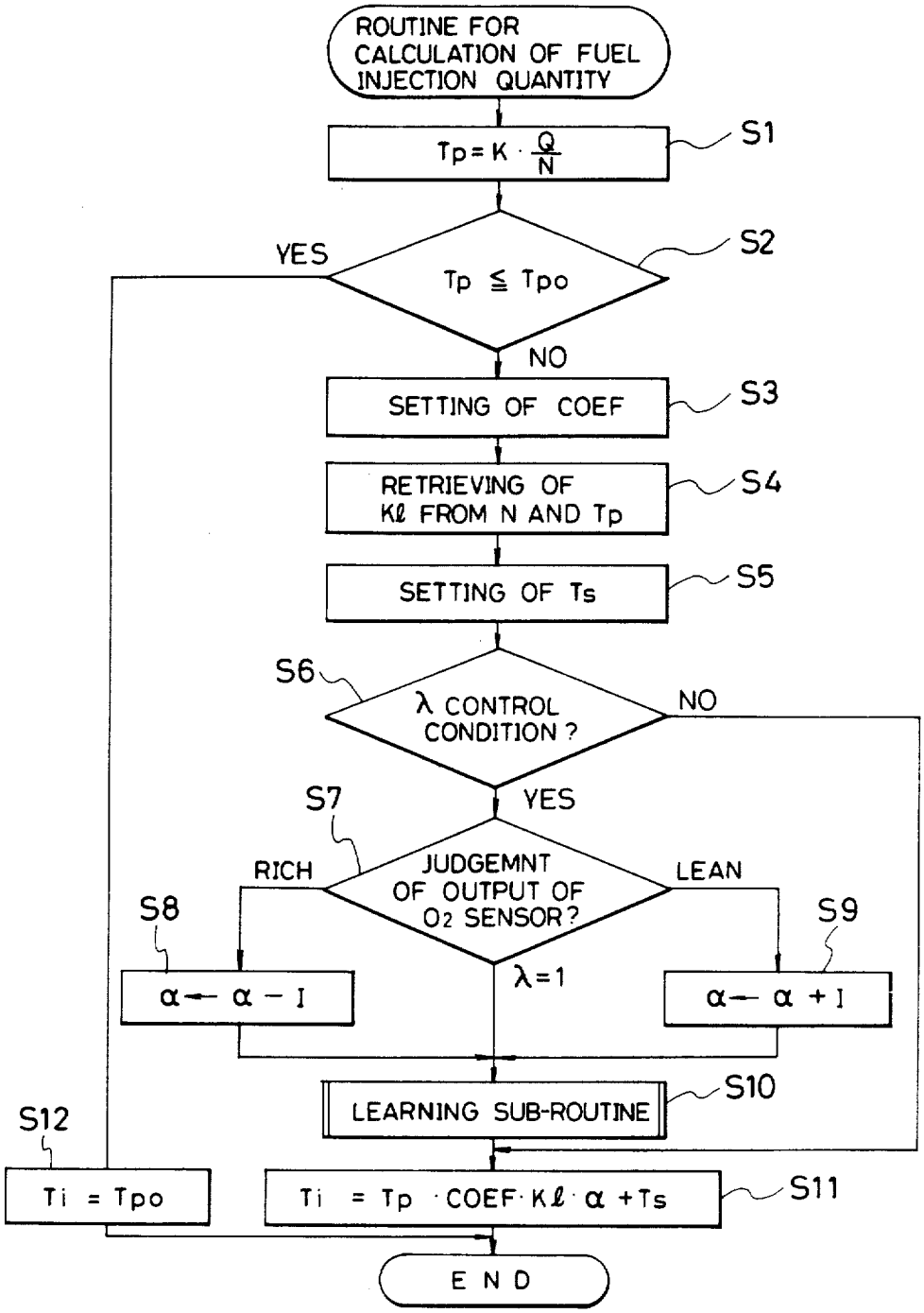
FIG. 5 is a flow chart illustrating the operation of the air-fuel ratio learning and control apparatus shown in FIG. 3.
Figure 6A:
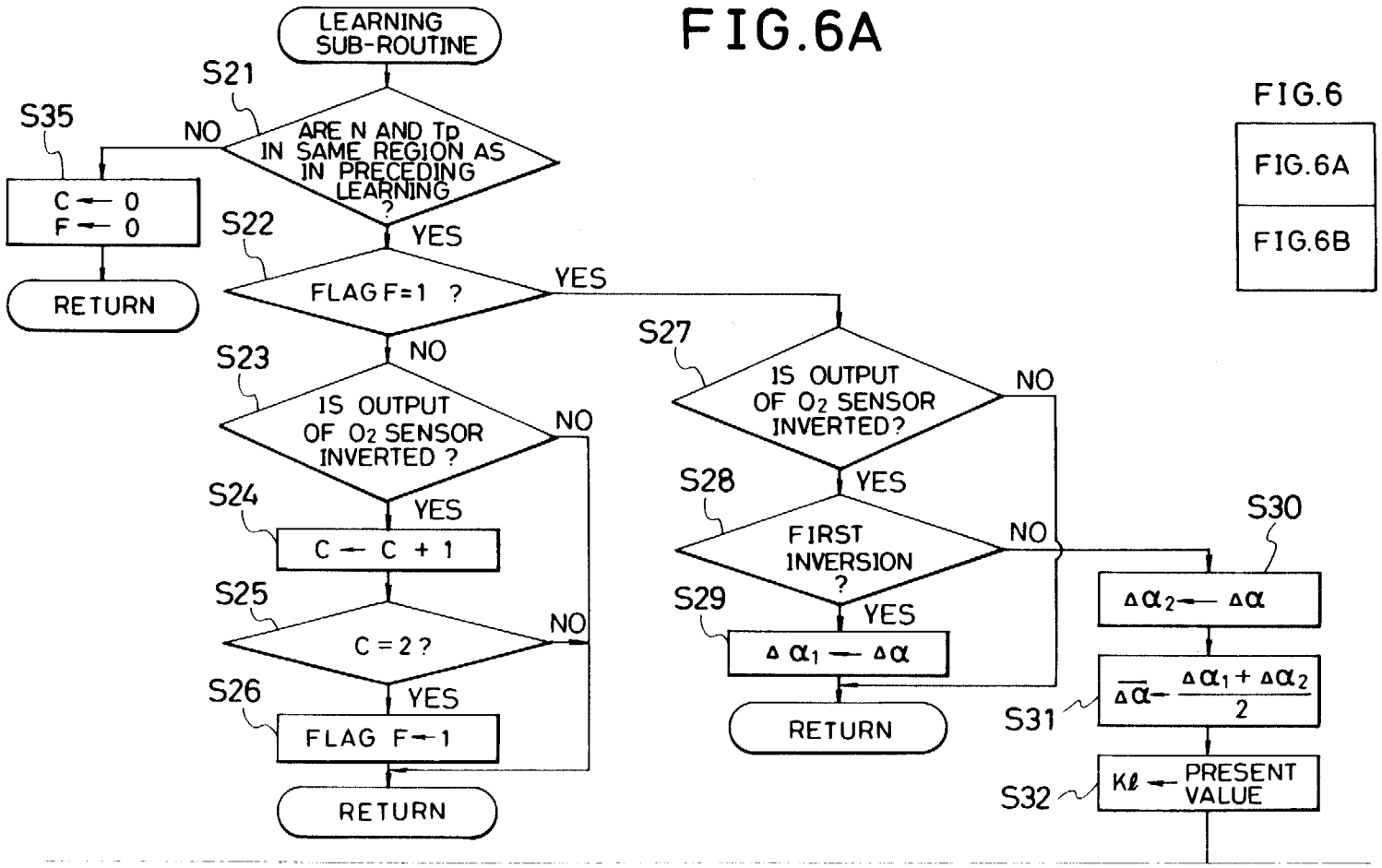
Figure 6B:
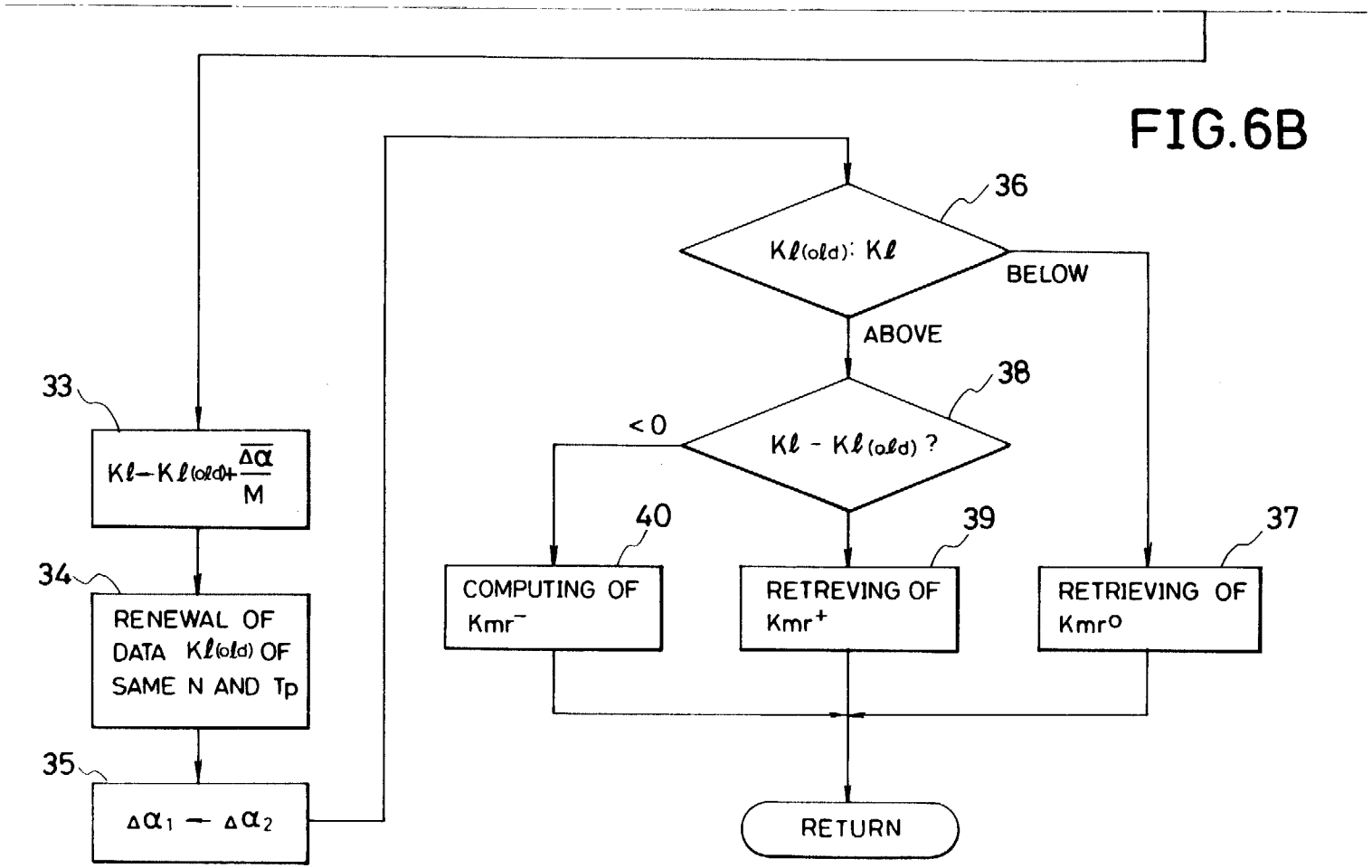

In the present invention, CPU 101 operates according to a program (stored in ROM 102) shown in FIGS. 5 and 6. In this embodiment, CPU 101 acts as basic control value setting means, learning correction quantity retrieving means, feedback correction quantity setting means, renewal means, control value computing means, learning correction quantity difference computing means, judging means and correcting means. Control means is constructed by CPU 101 and the fuel injection valve 25.

The operation will now be described with reference to FIGS. 5 and 6.

In the fuel injection quantity calculating routine shown in FIG. 5, at step 1 (S1 in the drawings), the base fuel injection quantity Tp ($=K \cdot Q/N$) is calculated from the flow quantity Q of sucked air obtained by a signal of the air flow meter 21 and the rotation number N of the engine obtained by a signal of the crank angle sensor 31. This portion corresponds to the basic control value computing means.

Figure 7:
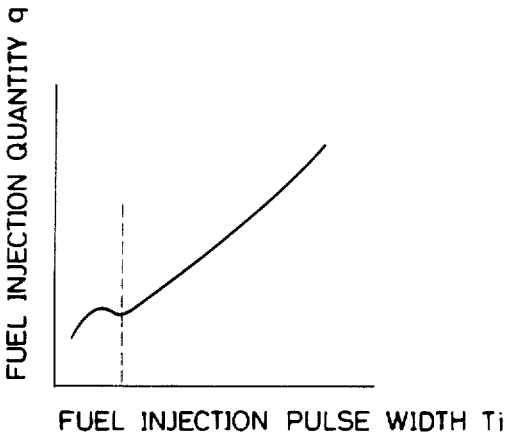
FIG. 7 is a graph illustrating the relation between the fuel injection pulse width and the fuel injection quantity.

At step 2, it is judged whether or not the base fuel injection quantity Tp computed at step 1 is smaller than the upper limit set value Tpo. As shown in FIG. 7, the linearity of the relation between the injection pulse width Ti and the actual fuel injection quantity q is lost in the region where the fuel injection quantity q is small, and a reverse characteristic region where the quantity q is increased with decrease of the width Ti is produced. Accordingly, if feedback control of the air-fuel ratio is carried out in this region, it is detected that the air-fuel ratio is rich, and the air-fuel ratio feedback coefficient $\alpha$ is decreased to decrease Ti, and as the result, it happens that the quantity q is increased and the divergent control is effected so that the air-fuel ratio is made much richer. Furthermore, if learning control is carried out in addition to the air-fuel ratio feedback control, the learning correction coefficient is increased and corrected so that Ti is increased to correct the deviation of the air-fuel ratio to the rich side, and the divergency of control at the transitional driving is further increased. The above-mentioned judgement is performed so as to eliminate these disadvantages.

In the case where the answer of the judgement at step 2 is "No", the routine goes to step 3, and various correction coefficients COEF are set according to need.

At step 4, from the rotation number N of the engine and the base fuel injection quantity (load) Tp, which represent the driving state of the engine, the corresponding learning correction coefficient K1 is retrieved. This portion corresponds to the learning correction coefficient retrieving means.

A map in which the engine rotation number N is plotted on the abscissa and the base fuel injection quantity Tp is plotted on the ordinate is divided into regions by about $8 \times 8$ lattices, and the learning correction coefficient K1 for each region is stored in memory means, RAM 103. Incidentally, before initiation of learning, all of the learning correction coefficients K1 are set at the initial value of 1.

At step 5, the voltage correction value Ts is set based on the voltage of the battery 43.

At step 6, it is judged whether or not the condition is the $\lambda$ control condition.

In the case where the condition is not the $\lambda$ control condition, for example, in case of high-rotation high-load region, the routine goes to step 11 described below from step 6 in the state where the feedback correction coefficient $\alpha$ is clamped to the precedent value (or standard value of 1).

In case of the $\lambda$ control condition, at steps 7 through 9, the output voltage Vo2 of the $O_2$ sensor 26 is compared with the slice level voltage Vref corresponding to the theoretical air-fuel ratio and it is judged whether the air-fuel ratio is rich or lean, and the feedback correction coefficient $\alpha$ is set by integration control or proportional integration control. This portion corresponds to the feedback correction coefficient setting means. More specifically, in case of integration control, if by comparison at step 7, it is judged that the air-fuel ratio is rich ($Vo2 > Vref$), the feedback correction coefficient $\alpha$ is set by reducing a predetermined integration portion (I) from the preceding value at step 8. In contrast, if it is judged that the air-fuel ratio is lean ($Vo2 < Vref$), at step 9 the feedback correction coefficient $\alpha$ is set by adding the predetermined integration portion (I) to the preceding value. In case of proportional integration control, in addition to the above-mentioned control, at the time of rich-lean inversion, a predetermined proportional portion (P) larger than the integration proportion (I) is subtracted or added in the same direction as that of the integration portion (I).

At step 10, the operation of the learning sub-routine shown in FIG. 6 is carried out, as described hereinafter.

Then, at step 11, the fuel injection quantity Ti is calculated according to the equation of $Ti = Tp \cdot COEF \cdot K1 \cdot \alpha + Ts$. This portion corresponds to the control value computing means.

Incidentally, the value retrieved at step 4 or the value corrected through the learning sub-routine shown in FIG. 6 is used as K1.

In the case where the judgement at step 2 is "Yes", the routine goes to step 12 and the fuel injection quantity Ti is maintained at the predetermined value Tpo, whereby in the region where the linearity of the relation between the fuel injection pulse width and the fuel injection quantity is lost, the air-fuel ratio feedback control and the learning control are stopped to maintain a uniform fuel injection quantity and prevent divergent control of the air-fuel ratio to the rich side.

If the fuel injection quantity Ti is calculated, a driving pulse signal having the pulse width of this Ti is put out at a predetermined timing synchronously with the rotation of the engine and given to the fuel injection value 25 through the current wave control circuit 121. This portion corresponds to the control means.

The learning sub-routine shown in FIG. 6 will now be described.

At step 21, it is judged whether or not the engine rotation number N and base fuel injection quantity Tp which represent the driving state of the engine are in the same region as the preceding region. In case of "Yes", at step 22 it is judged whether or not a flag F is set. If the flag F is not set, at step 23 it is judged whether or not the output of the $O_2$ sensor 26 is inverted, that is, whether or not the increase-decrease direction of the feedback correction coefficient $\alpha$ is inverted. This flow is repeated and at every inversion, the count value indicating the inversion frequency is increased by 1 at step 24, and when the count value becomes 2, the routine goes to step 26 from step 25 to set the flag F. When the output of the $O_2$ sensor 26 is inverted 2 times in the same region, this flag F is regarded as becoming constant driving state and is set. After setting of the flag F, if the same region is judged at step 21, the routine goes to step 27 through step 22. At steps 22 through 26, the constant state is detected if (1) the driving state of the engine is in one of the sectioned regions and (2) the increase-decrease direction of the feedback correction coefficient $\alpha$ is inverted at least a predetermined number of times (at least 2 times).

In the constant state, at step 27, it is judged whether or not the output of the $O_2$ sensor 26 is inverted, that is, whether or not the increase-decrease direction of the feedback correction coefficient $\alpha$ is inverted, and this flow is repeated and when inversion is caused, at step 28 it is judged whether or not the inversion is the first inversion after judgement of the stationary state, that is, whether or not the inversion is the third inversion in the same region. When it is judged that the inversion is the third inversion, at step 29 the deviation $\Delta\alpha(=\alpha-\alpha 1)$ of the present feedback correction coefficient $\alpha$ from the standard value $\alpha 1$ is temporarily stored as $\Delta\alpha 1$. Then, if the fourth inversion is detected, the routine goes to steps 30 through 34, and learning is carried out based on data between the third inversion and the fourth inversion (see FIG. 4). When the fifth inversion and subsequent inversions are detected, the routine similarly goes to steps 30 through 34 and learning is carried out based on the preceding inversion and the present inversion.

Figure 4:
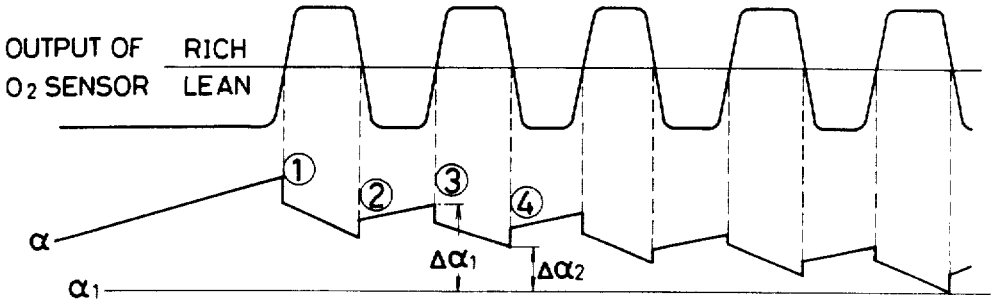
FIG. 4 is a graph illustrating the output voltage characteristics of an $O_2$ sensor.

At the fourth inversion and subsequent inversions, the deviation $\Delta\alpha(=\alpha-\alpha 1)$ of the present feedback correction coefficient $\alpha$ from the standard value $\alpha 1$ is temporarily stored as $\Delta\alpha 2$ at step 30. As shown in FIG. 4, the stored $\Delta\alpha 1$ and $\Delta\alpha 2$ values are upper and lower peak values of $\Delta\alpha$ between the preceding inversion (for example, the third inversion) and the present inversion (for example, the fourth inversion). The portion of steps 27 through 30 corresponds to the deviation peak value detecting means of the learning correction quantity correcting means. Since the means value $\Delta\alpha$ of the deviation $\Delta\alpha$ can be calculated based on these upper peak values $\Delta\alpha 1$ and $\Delta\alpha 2$, at step 31 the mean value $\Delta\alpha$ of the deviation $\Delta\alpha$ is calculated according to the formula of $\Delta\alpha=(\Delta\alpha 1+\Delta\alpha 2)/2$. This portion corresponds to the mean deviation value computing means of the learning correction quantity correcting means.

Then, at step 32 the learning correction coefficient K1 stored in correspondence to the present region is retrieved. However, practically, the value retrieved at step 3 can be used.

Then, at step 33, a new learning correction coefficient K1(new) is calculated by adding a predetermined proportion of the mean value $\Delta\alpha$ of the deviation $\Delta\alpha(=\alpha-\alpha 1)$ of the feedback correction coefficient $\alpha$ from the standard value $\alpha 1$ to the present learning correction coefficient K1 according to the formula of K1(new)$\leftarrow$K1(old)$+\Delta\alpha/M$ (in which M is a constant larger than 1).

At step 34, the old learning correction coefficient K1(old) is renewed to the new learning correction coefficient K1(new) stored in the corresponding region. The portion of the step 33 corresponds to the learning correction difference computing means and the portion of the step 34 corresponds to the learning correction renewal means.

Then, at step 35, the value $\Delta\alpha 2$ is substituted for $\Delta\alpha 1$ for the subsequent calculation.

In the case where at step 21 it is judged that the driving state is not in the same region as the preceding region, the count value C is cleared at step 35 and the flag F is reset.

At step 36, it is judged whether or not the ratio between the learning correction coefficient K1(old) before the renewal and the new learning correction coefficient K1 is larger than a predetermined value (the ratio between the learning correction coefficient before learning and the learning correction coefficient after first learning). If the above-mentioned ratio is larger than the predetermined value, it is judged that the learning correction coefficient K1 is abnormal, and the routine goes to step 38. If the above-mentioned ratio is smaller than the predetermined value, the routine goes to step 37 and the air-fuel ratio correction coefficient Kmr° at the time of normal control is retrieved. The coefficient Kmr is stored in RAM corresponding to the engine driving states.

At step 38, it is judged whether or not the difference between the new learning correction coefficient K1 and the learning correction coefficient K1(old) before the renewal is larger than 0, and if the difference is a positive value, since this means that the air-fuel ratio becomes lean and the air-fuel ratio correction coefficient $\alpha$ is increased to increase the learning correction coefficient K1, it is judged that the fuel injection quantity is abnormally decreased, for example, by clogging of the fuel injection valve, and an air-fuel ratio correction coefficient Kmr+ larger than the above-mentioned air-fuel ratio correction coefficient Kmr° is retrieved at step 39 (As mentioned already an air-fuel ratio correction coefficient Kmr is included in COEF). If the above-mentioned difference is a negative value, since this means that the air-fuel ratio becomes rich and the air-fuel feedback correction coefficient $\alpha$ is decreased to decrease the learning correction coefficient K1, it is judged that the fuel injection quantity from the fuel injection valve is abnormally increased, and at step 40, an air-fuel ratio correction coefficient Kmr− smaller than the above-mentioned air-fuel ratio correction coefficient Kmr° is retrieved.

As the result, the portion of steps 36 and 38 corresponds to the judging means and the portion of steps 37, 39 and 40 corresponds to the correcting means.

As is apparent from the foregoing description, since the fuel injection quantity is changed by changing the air-fuel ratio correction coefficient according to the difference between the learning correction coefficient K1(old) before the renewal and the new learning correction coefficient K1, even if the actual injection quantity is changed by a trouble of the fuel injection valve or the like, the injection quantity can be controlled with a good respondency to this change, and the learning speed is increased and degradation of the exhaust characteristics can be prevented.

Incidentally, the air-fuel ratio correction coefficient is changed in the foregoing embodiment for learning control for the engine, but the air-fuel ratio feedback correction coefficient $\alpha$ or the learning correction coefficient K1 may be changed instead. Furthermore, the present invention can be applied to the learning control for controlling the idle rotation number or the learning control for controlling the ignition timing.

What is claimed is:

1. A learning and control apparatus for an electronically controlled internal combustion engine, which comprises means for detecting driving states of the engine, means for detecting an actual controlled value of the engine, basic control value setting means for setting a basic control value corresponding to a desired control value of an object of control in the detected driving states of the engine, memory means for storing a learning correction quantity for correcting the basic control value for every region of the driving state of the engine, learning correction quantity retrieving means for retrieving a learning correction quantity from said memory means under the same driving conditions as those of the actual controlled value detected, feedback correction quantity setting means for comparing the actual controlled value detected with the desired control value and correcting said basic control value so that the actual controlled value is brought close to the aimed control value, learning correction quantity renewal means for setting a new learning correction quantity from the feedback correction quantity and the retrieved learning correction quantity and renewing the learning correction quantity stored in the memory means under the same driving states by said new learning correction quantity, control value computing means for computing a control value from said basic control value, the retrieved learning correction quantity and the set feedback correction quantity, learning correction quantity difference computing means for computing the difference between the retrieved precedent learning correction quantity and the new learning correction quantity, judging means for judging whether or not the computed difference is larger than a predetermined value, correcting means for increasing or decreasing said control value by a predetermined quantity according to said difference when it is judged that said difference is larger than said predetermined value, and control means for controlling the engine based on the control value corrected by said correcting means when said difference is larger than said predetermined value or based on the control value of the control value computing means when said difference is smaller than said predetermined value.

2. A learning and control appartus for an electronically controlled internal combustion engine according to claim 1, wherein said object of control is amount of fuel injection from fuel injection means mounted on the engine which is opened and closed in an on-off manner by a driving pulse signal of said control means.

3. A learning and control apparatus for an electronically controlled internal combustion engine according to claim 1, wherein said object of control is idle rotation number of said engine provided with an idle speed control valve in which said valve determines the opening degree of a passage bypassing a throttle valve arranged in an intake passage by minute oscillation in the opening and closing direction according to a driving pulse signal of said control means.

4. An apparatus for learning and electronically controlling air-fuel ratio in an internal combustion engine, which comprises means for detecting the driving state of the engine, which includes first detecting means for detecting the flow quantity Q of air sucked in the engine, second detecting means for detecting the engine speed N and third detecting means for detecting exhaust components of the engine and detecting the actual value of the air-fuel ratio in an air-fuel mixture sucked in the engine, basic fuel injection quantity setting means for setting a basic fuel injection quantity corresponding to an desired air-fuel ratio from the flow quantity of sucked air put out from the first detecting means and the engine speed N put out from the second detecting means, reloadable memory means for storing a learning correction coefficient K1 for correcting the basic fuel injection quantity in every region of the driving state of the engine, learning correction coefficient retrieving means for retrieving a learning correction coefficient K1 of the corresponding region from said memory means based on the actual driving state of the engine, feedback correction coefficient setting means for comparing the air-fuel ratio put out from the third detecting means with the desired air-fuel ratio and setting a feedback correction coefficient $\alpha$ for correcting the basic fuel injection quantity by increasing or decreasing the feedback correction coefficient $\alpha$ by a predetermined quantity so that the actual air-fuel ratio is brought close to the desired air-fuel ratio, fuel injection quantity computing means for computing the fuel injection quantity based on the basic fuel injection quantity computed by said basic fuel injection quantity computing means, the learning correction coefficient K1 retrieved by the learning correction coefficient retrieving means and the feedback correction coefficient $\alpha$ set by the feedback correction coefficient setting means, learning correction coefficient correcting means for learning the deviation $\Delta\alpha$ of the feedback correction coefficient $\alpha$ of each region of the driving state of the engine from the standard value $\alpha 1$ and correcting and rewriting the learning correction coefficient K1 corresponding to each region of the driving state of the engine in a direction decreasing said deviation, learning correction coefficient difference computing means for computing the difference between the retrieved precedent learning correction coefficient K1(old) and the new learning correction coefficient K1, judging means for judging whether or not said computed difference is larger than a predetermined value, correcting means for increasing or decreasing the fuel injection quantity computed by said fuel injection quantity computing means by a predetermined quantity according to said difference when it is judged that said difference is larger than said predetermined value, fuel injection means for injecting and supplying a fuel to the engine in an on-off manner, and control means for controlling said fuel injection means based on the fuel injection quantity corrected by said correcting means when said difference is larger than said predetermined value or based on the fuel injection quantity from said fuel injection quantity computing means when said difference is smaller than said predetermined value.

5. An apparatus for learning and electronically controlling air-fuel ratio according to claim 4, wherein said basic fuel injection quantity setting means sets the basic fuel injection quantity based on a basic injection pulth width Tp of opening of said fuel injection means given by the following equations: $Tp=K\times Q/N$.

6. An apparatus for learning and electronically controlling air-fuel ratio according to claim 5, wherein said fuel injection quantity computing means computes the fuel injection quantity based on an injection pulse width Ti of opening of said fuel injection means given by the following equations:

$$Ti=Tp\times COEF\times K1\times\alpha+Ts$$

wherein Ts stands for the quantity of the voltage correction efficient for correcting the change of the voltage of a battery, $COEF=1+Ktw+Kmr+Ketc$ in which Ktw stands for a coefficient for increasing the fuel injection quantity corresponding to a cooling-water temperature, Kmr stands for a coefficient for correcting the air-fuel mixture, and Ketc stands for other correction coefficient for increasing the fuel injection quantity.

7. An apparatus for learning and electronically controlling air-fuel ratio according to claim 6, wherein said learning correction coefficient correcting means computes the difference given by the following equations:

$$K1\leftarrow K1\ (\text{old})+\overline{\Delta\alpha}/M\ (M>1)$$

$$\overline{\Delta\alpha}=(\Delta\alpha 1+\Delta\alpha 2)/2$$

$$\Delta\alpha=\alpha-\alpha 1$$

in which $\Delta\alpha 1$ stands for the deviation $\Delta\alpha$ of the precedent feedback correction coefficient $\alpha$ from the standard value $\alpha 1$ when the precedent output of the $O_2$ sensor is inverted and then the precedent feedback correction coefficient $\alpha$ is inverted, $\Delta\alpha 2$ stands for the deviation $\Delta\alpha$ of the present feedback correction coefficient $\alpha$ from the standard value $\alpha 1$ when the present output of the $O_2$ sensor is inverted and then the present feedback correction coefficient $\alpha$ is inverted and M stands for a constant.

8. An apparatus for learning and electronically controlling air-fuel ratio according to claim 6 or claim 7, wherein said fuel injection quantity computing means comprises a second reloadable memory means for storing the air-fuel ratio correctin coefficient Kmr and said correcting means increases the air-fuel ratio correction coefficient Kmr retrieved from said second reloadable memory means corresponding to the engine driving condition when the difference between new and precedent learning correction coefficients K1 is a positive value or decreases the air-fuel ratio correction coefficient Kmr when the difference between learning coefficients K1 is a negative value.

9. An apparatus for learning and electronically controlling air-fuel ratio according to claim 8, wherein said control means controls said fuel injection means based on the learning correction coefficient K1 corrected by said correcting means when said difference is larger than said predetermined value or based on the learning correction coefficient K1 retrieved from said second memory means when said difference is smaller than said predetermined value.

10. An apparatus for learning and electronically controlling air-fuel ratio according to claim 6 or claim 7, wherein said correcting means corrects the air-fuel ratio feedback correction coefficient $\alpha$.

11. An apparatus for learning and electronically controlling air-fuel ratio according to claim 6 or claim 7, wherein said correcting means corrects the learning correction coefficient K1.

12. An apparatus for learning and electronically controlling air-fuel ratio according to claim 4, wherein said fuel injection quantity computing means further comprises means for setting the fuel injection quantity at a constant level higher than a predetermined value in a small injection quantity region.

* * * * *

UNITED STATES PATENT AND TRADEMARK OFFICE

CERTIFICATE OF CORRECTION

'ATENT NO. : 4,729,359

)ATED : March 8, 1988

NVENTOR(S) : Naoki Tomisawa and Yasunari Koshiba

It is certified that error appears in the above-identified patent and that said Letters Patent is hereby orrected as shown below:

)n the title page, after "[22] Filed: June 25, 1986" insert

-- [30] Foreign Application Priority Data

| | | | |
|---|---|---|---|
| June 28, 1985 | [JP] | Japan | 60-140476 |
| Nov. 6, 1985 | [JP] | Japan | 60-246958--. |

Signed and Sealed this

Fifth Day of July, 1988

*Attest:*

DONALD J. QUIGG

*Attesting Officer*

*Commissioner of Patents and Trademarks*